US012281608B2

(12) United States Patent
Kis

(10) Patent No.: US 12,281,608 B2
(45) Date of Patent: Apr. 22, 2025

(54) HEAT EXCHANGER MODULE

(71) Applicant: Modine Manufacturing Company, Racine, WI (US)

(72) Inventor: Michael Kis, Sturtevant, WI (US)

(73) Assignee: Modine Manufacturing Company, Racine, WI (US)

( * ) Notice: Subject to any disclaimer, the term of this patent is extended or adjusted under 35 U.S.C. 154(b) by 146 days.

(21) Appl. No.: 18/313,845

(22) Filed: May 8, 2023

(65) Prior Publication Data

US 2023/0272735 A1 Aug. 31, 2023

Related U.S. Application Data

(63) Continuation-in-part of application No. 17/541,816, filed on Dec. 3, 2021, now Pat. No. 11,679,665.

(60) Provisional application No. 63/121,224, filed on Dec. 3, 2020.

(51) Int. Cl.
*F01P 11/10* (2006.01)

(52) U.S. Cl.
CPC ..... *F01P 11/10* (2013.01)

(58) Field of Classification Search
CPC ..... B60K 11/04; F01P 3/18; F01P 2003/182; F01P 5/06; F01P 11/00; F04D 29/644; F04D 29/703; F28D 2021/008; F28F 9/002

See application file for complete search history.

(56) References Cited

U.S. PATENT DOCUMENTS 5,597,047 A * 1/1997 Thompson ..... F28F 9/002 180/68.6
6,098,702 A * 8/2000 Shadbourne ..... B60H 1/00535 165/81
6,676,371 B1 1/2004 Brown
(Continued)

FOREIGN PATENT DOCUMENTS

DE 3916777 A1 * 4/1990
DE 19602186 C1 * 5/1997 ..... B60K 11/08
(Continued)

OTHER PUBLICATIONS

International Search Report with Written Opinion issued for Application No. PCT/US2021/061778 dated Feb. 23, 2022 (14 Pages).
(Continued)

*Primary Examiner* — Hung Q Nguyen
(74) *Attorney, Agent, or Firm* — Michael Best & Friedrich LLP

(57) ABSTRACT

A fan shroud assembly mounts a radiator to a vehicle frame. The fan shroud assembly includes a fan shroud, a first frame bracket for mounting the fan shroud to the vehicle frame, and a second frame bracket for mounting the fan shroud to the vehicle frame. The first frame and second brackets include a bottom wall and a back wall. The fan shroud includes: an air chamber wall defining an air chamber and configured to support the radiator; an air outlet at a first side of the air chamber wall; an air inlet at a second side of the air chamber wall opposite from the first side; a first section of the air chamber wall extending between the air inlet and the air outlet; and a second section of the air chamber wall extending between the air inlet and the air outlet.

20 Claims, 12 Drawing Sheets

(56) References Cited

U.S. PATENT DOCUMENTS

| | | | | |
|---|---|---|---|---|
| 10,661,650 | B2 | 5/2020 | Shiheiber | |
| 10,906,388 | B2 | 2/2021 | Shiheiber | |
| 11,964,550 | B2 | 4/2024 | Shiheiber | |
| 2002/0110462 | A1 | 8/2002 | Hunt | |
| 2004/0250987 | A1* | 12/2004 | Kalbacher | F04D 29/582 165/67 |
| 2005/0042088 | A1 | 2/2005 | Horski et al. | |
| 2006/0081353 | A1* | 4/2006 | Inniger | F04D 29/582 415/214.1 |
| 2007/0048138 | A1 | 3/2007 | Horski et al. | |
| 2011/0240252 | A1* | 10/2011 | Borski | F28F 9/002 165/51 |
| 2012/0321474 | A1* | 12/2012 | Stevens | F04D 29/545 416/190 |
| 2015/0167532 | A1 | 6/2015 | Kim | |
| 2016/0001629 | A1 | 1/2016 | Rohr | |
| 2016/0138610 | A1* | 5/2016 | Jung | F04D 29/164 415/173.1 |
| 2017/0059257 | A1 | 3/2017 | Wang | |
| 2017/0166043 | A1 | 6/2017 | Yun et al. | |
| 2019/0085866 | A1 | 3/2019 | Ota et al. | |
| 2021/0003065 | A1 | 1/2021 | Cremering et al. | |

FOREIGN PATENT DOCUMENTS

| | | | | |
|---|---|---|---|---|
| DE | 102015224344 | A1 | 6/2017 | |
| EP | 0886048 | A2 | 12/1998 | |
| EP | 1757479 | A2 * | 2/2007 | B60K 11/04 |
| KR | 1020110136165 | A | 12/2011 | |
| WO | WO-9930916 | A1 * | 6/1999 | B60H 1/00535 |
| WO | 2020229492 | A1 | 11/2020 | |

OTHER PUBLICATIONS

Canadian Patent Office Action for Application No. 3203590 dated Dec. 9, 2024 (3 pages).

European Patent Office Action for Application No. 21901519.5 dated Oct. 17, 2024 (10 pages).

* cited by examiner

HEAT EXCHANGER MODULE

RELATED APPLICATIONS

This application is a continuation-in-part of U.S. application Ser. No. 17/541,816, filed Dec. 3, 2021, which claims priority to U.S. provisional application No. 63/121,224, filed Dec. 3, 2020, the entire content of which is hereby incorporated by reference.

BACKGROUND

The invention relates to vehicle powertrain heat exchanger modules and vehicle heat exchange systems for regulating the temperature of vehicle components depending on vehicle conditions and the temperature of heat exchanger fluids, and especially to the way that such heat exchanger modules are mounted to the vehicle. Heat exchanger modules have been mounted to vehicles by module frames which attach to the vehicle at the vehicle frame or other location and to which the heat exchangers are attached and supported. Module frames have provided adequate support for the heat exchangers in such a configuration due to the structural strength and configuration of the module frames. Frameless designs for heat exchanger modules also exist, but require extra structural supports, like struts or tie bars, or extra support via structure or configuration of tanks of the heat exchangers.

SUMMARY

As disclosed in detail herein, the combination of heat exchanger modules and a structural shroud offers advantages to the structure of a vehicle heat exchange system. The structural shroud provides structural support to the overall heat exchanger system. This improved design over a conventional frameless heat exchanger mounting design provides rigid mount support to heat exchangers even when the heat exchangers have varying heights. For example, based on other vehicle requirements, a charge air cooler may be of a design that is shorter in length than a radiator core. Conventional designs may require extensions from the bottom of, for example, charger air cooler tanks, to mount to the radiator core. These extensions can be structurally vulnerable.

Conventional frameless heat exchanger mounting designs are also known to be structurally vulnerable. In conventional designs stresses from normal use are absorbed by a heat exchanger tube or header, channels (e.g., steel channels) that house the radiator, cross braces that connect a radiator corner to the vehicle frame or other mounting location, and/or the radiator itself. Damaging loads applied by a vehicle onto the heat exchangers are removed or mitigated by the support of the structural shroud as provided herein. The structural support provided by the structural shroud reduced the loads on these components, or in some embodiments, replaces these components entirely.

In some vehicle applications, the size of the radiator core requires that the radiator core extends far below a main module mount, i.e., far below the primary connection between the heat exchanger module and the vehicle frame. This extension of the radiator core acts as a lever arm and increases the stresses subjected to the radiator core from vibration inputs that result from operation of the vehicle. In these embodiments, the improved stability and/or rigidity of the structural shroud provided herein allows for stability rods to be shortened or replaced without increased stresses on the radiator core.

In embodiments where stability arms are still required, the frameless design provided herein allows mounting points for connections to the stability rods to be incorporated or integrated directly into the shroud geometry. Integrating the mounting points into the shroud allows for easier packaging and location flexibility, as well as greater durability.

The main module mount of the structural shroud also provides advantages over conventional designs. For example, the main module mount is located at or near the center of gravity of the heat exchanger unit, which reduces stresses applied to the entire assembly resulting from operation of the vehicle. Conventional designs instead require mounting the heat exchanger module via the charge air cooler tanks, which results in the heat exchanger module not being mounted at the center of mass, which in turn leads to higher stresses in the entire assembly. The main module mount provided herein (also referred to herein as first and second frame brackets) instead advantageously connects the heat exchanger module to the vehicle frame at a connection between the charge air cooler and the shroud. This allows for mounting the heat exchanger module closer to its center of mass, which reduces stresses in the heat exchanger assembly.

The main module mount can be formed into a split main module mount, which improves stability and, in some embodiments, eliminates the need for stabilizer rods at the top and bottom portion of the charge air cooler. The split main module mount is provided with two different, e.g., "front" and a "rear", isolators to improve stability of the main module mount via the added connections to the vehicle frame. The front isolator is installed into a pocket of charge air cooler casting on a front side of the center of gravity of the heat exchanger module. The rear isolator is installed on an opposite side of the center of gravity of the heat exchanger module and connects the structural shroud to the vehicle frame.

The structural shroud material is a reinforced polyamide material, although other embodiments are contemplated. Reinforced polyamide materials provide advantages over conventional talc filled polypropylene material used for conventional commercial vehicle shrouds through improved strength and structural rigidity of the shroud. More generally, the shroud is formed from plastic. In other embodiments the shroud is formed from stamped steel. The shroud can be formed in some embodiments from a single sheet of stamped steel that is formed into the shroud shape, or be formed from several pieces of stamped steel that are later welded or otherwise fastened together during the manufacturing process.

According to an embodiment of the invention, a heat exchanger module is configured to mount to a vehicle frame at first, lateral side and at an opposite, second, lateral side of the heat exchanger module. A first heat exchanger and a second heat exchanger are arranged consecutively in a depth direction of the heat exchanger module, and a fan shroud is located at one end of the heat exchanger module in the depth direction, next to the first heat exchanger, where the first exchanger is located between the fan shroud and the second heat exchanger. The first heat exchanger has a first core with a first core depth in the depth direction, and the second heat exchanger has a second core with a second core depth in the depth direction. The second heat exchanger has a first mounting bracket on the first, lateral side and a second mounting bracket on the second, lateral side. The fan shroud includes an outer periphery defined by at least a portion of an outer peripheral wall extending in the depth direction, and the outer peripheral wall defines at least a portion of a cavity that extends in the depth direction. The cavity includes at least one inner support wall extending in the depth direction. The fan shroud has a first frame bracket extending from the outer periphery on the first, lateral side and a second frame bracket extending from the outer periphery on the second, lateral side. The fan shroud is attached to each of the first heat exchanger and the second heat exchanger by at least one fastener that extends through the fan shroud. The first frame bracket is connected to the vehicle frame at a first connection location, and the second frame bracket is connected to the vehicle frame at a second connection location. The first mounting bracket is connected to the vehicle frame at a third connection location, and the second mounting bracket is connected to the vehicle frame at a fourth connection location. The first connection location is spaced apart from the third connection location by a first distance in the depth direction. The second connection location is spaced apart from the fourth connection location by a second distance in the depth direction.

Also, according to this embodiment, a fan shroud for mounting a heat exchanger module includes an air inlet at a first side of the fan shroud and an air outlet at a second side spaced-apart in a depth direction from the first side. An air chamber of the fan shroud extends between the air inlet and the air outlet and is at least partially defined by an air chamber wall. Outer support walls are located along a periphery of the fan shroud and extend in the depth direction, spaced-apart from the air chamber wall. The fan shroud further has a first frame bracket and a second frame bracket, where each of the first frame bracket and the second frame bracket extend outwardly from the outer support walls. There are two upper holes in the fan shroud where fasteners can extend through to connect to heat exchangers, the two upper holes being spaced-apart from the first frame bracket and the second frame bracket. There are two lower holes in the fan shroud where fasteners can extend through to connect to heat exchangers. The two lower holes are also spaced-apart from the first frame bracket and the second frame bracket. Inner support walls of the fan shroud extend in the depth direction within the periphery of the fan shroud, such that some the inner support walls are connected to the air chamber wall and one of the outer support walls, some of the inner support walls are just connected to the air chamber wall, and some of the inner support walls are just connected one or more than one of the outer support walls.

Also, according to this embodiment, a fan shroud assembly mounts a radiator to a vehicle frame. The fan shroud assembly includes a fan shroud, a first frame bracket, and a second frame bracket, where the first and second frame brackets are configured to mount the fan shroud to the vehicle frame. The first frame bracket includes a bottom wall and a back wall. The second frame bracket includes a bottom wall and a back wall. The fan shroud includes: an air chamber wall defining an air chamber and configured to support the radiator; an air outlet at a first side of the air chamber wall; an air inlet at a second side of the air chamber wall opposite from the first side; a first section of the air chamber wall extending between the air inlet and the air outlet; and a second section of the air chamber wall extending between the air inlet and the air outlet. The second section is positioned across the air chamber from the first section. The bottom wall of the first frame bracket is configured to connect to the vehicle frame. The bottom wall of the first frame bracket includes a hole. The back wall of the first frame bracket is mounted to the first section of the air chamber wall. The bottom wall of the second frame bracket is configured to connect to the vehicle frame. The bottom wall of the second frame bracket includes a hole. The back wall of the second frame bracket is mounted to the second section of the air chamber wall.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

A heat exchanger module embodying the present invention is shown in the figures and can provide a frameless structure for a plurality of heat exchangers and a fan shroud to be mounted to a vehicle frame.

Figure 1:
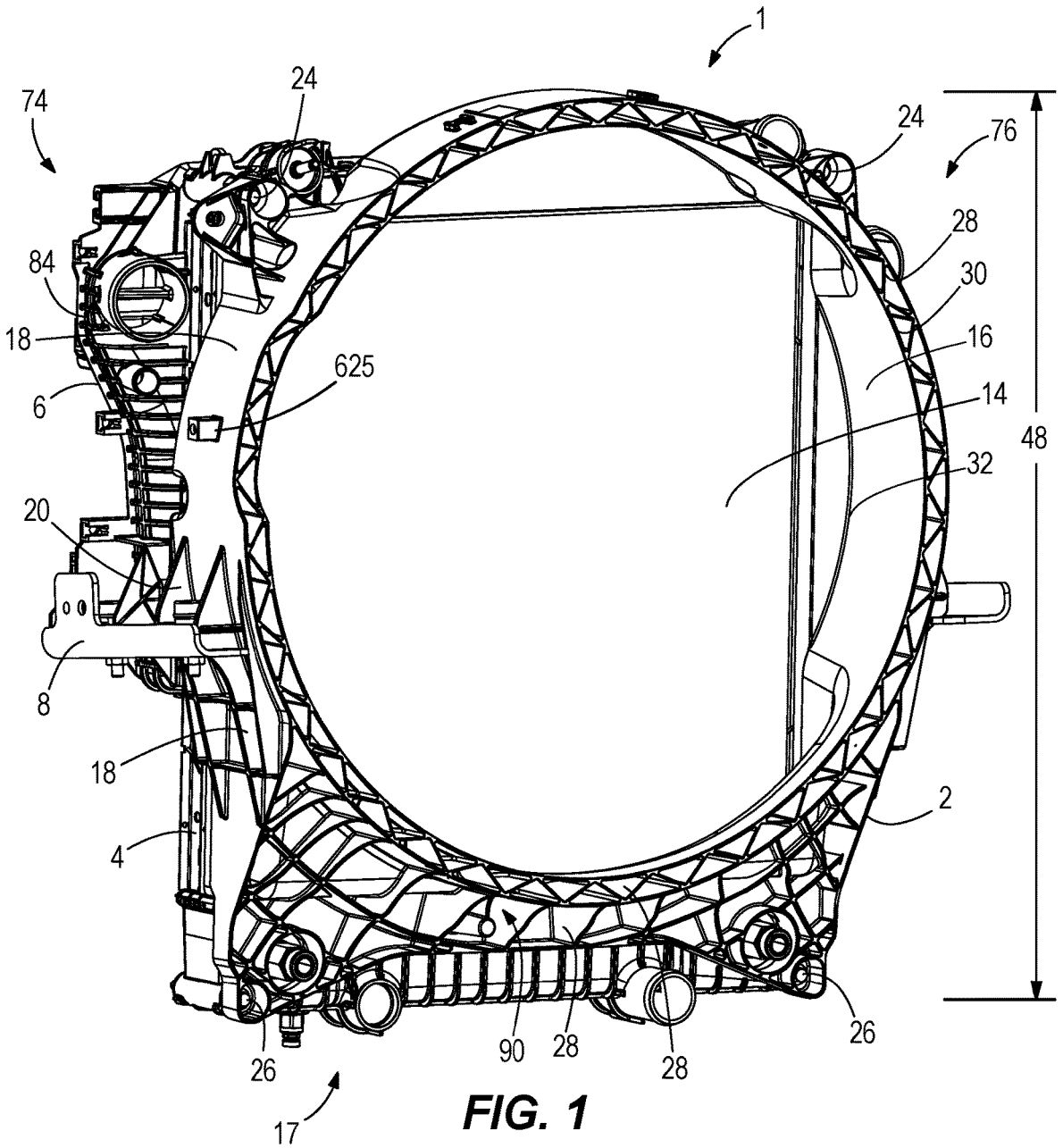
FIG. 1 is a front perspective view of a heat exchanger module.
Figure 2:
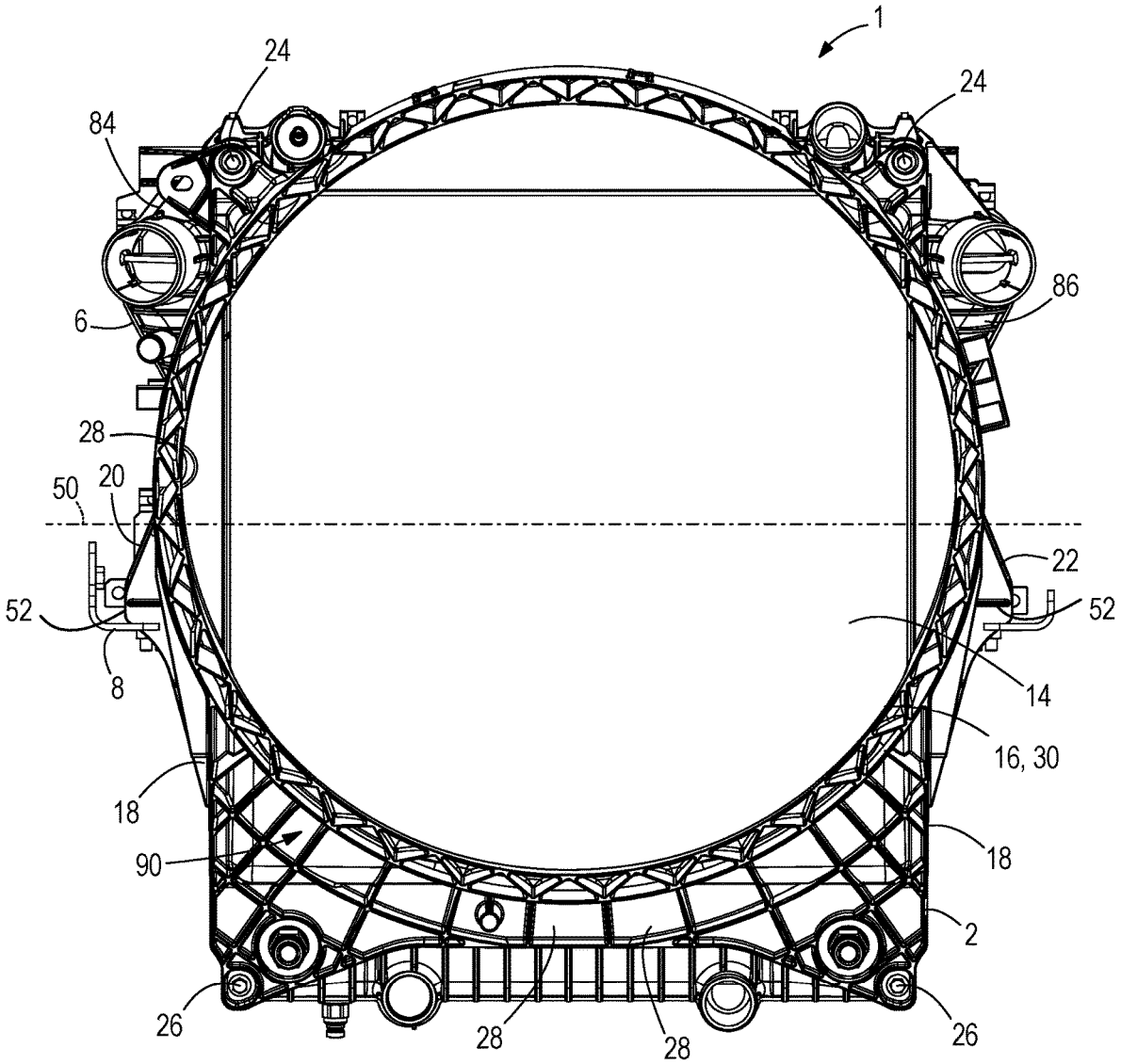
FIG. 2 is a front view of a heat exchanger module of FIG. 1.
Figure 3:
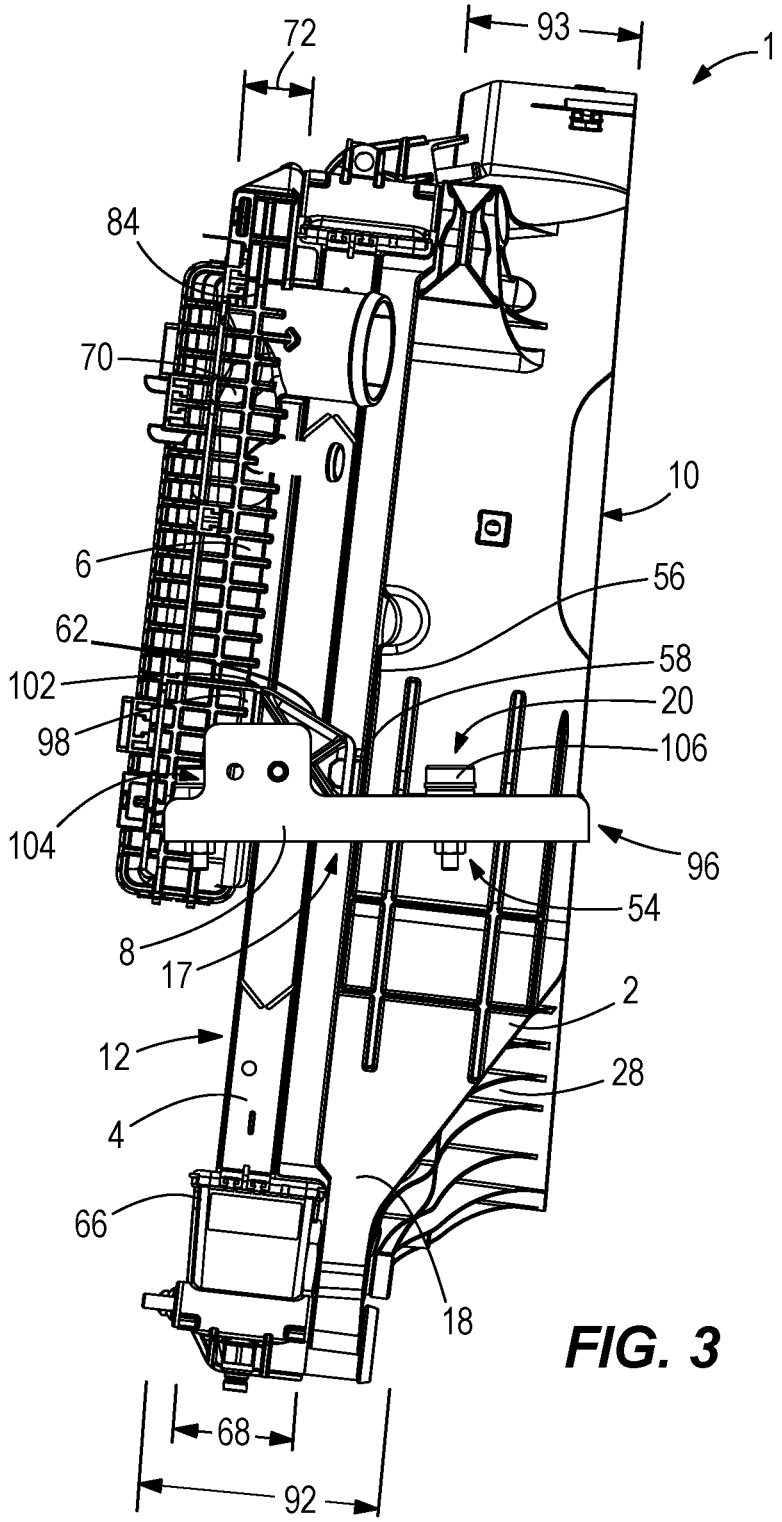
FIG. 3 is a side view of a heat exchanger module of FIG. 1.

As shown in FIGS. 1-3, the heat exchanger module 1 is attached to a vehicle frame 8 (partially shown). A first heat exchanger 4 and a second heat exchanger 6 are both mounted to a fan shroud 2 via fasteners and upper holes 24 in the fan shroud 2. As illustrated, the first heat exchanger 4 is a radiator core, and the second heat exchanger 6 is a charge air cooler, although the embodiments of the first heat exchanger 4 and second heat exchanger 6 are not limited to these devices.

The fan shroud 2 provides structural support to the first heat exchanger 4 and second heat exchanger 6. Through this added structural support, damaging loads applied by components of a vehicle are not passed along to the heat exchanger module 1. The fan shroud 2 can be formed of a reinforced polyamide material, although other materials are contemplated.

The first heat exchanger 4 is further mounted to the fan shroud 2 by fasteners and lower holes 26 in the fan shroud 2. The first heat exchanger 4 is located between the second heat exchanger 6 and the fan shroud 2 in a depth direction of the heat exchanger module. The depth direction is perpendicular to a height 48 of the fan shroud 2.

The fan shroud 2 further includes a first frame bracket 20 and a second frame bracket 22 along a periphery 17 of the fan shroud 2. The first and second frame brackets 20, 22 mount to the vehicle frame 8. The first frame bracket 20 is attached to the vehicle frame 8 at a first, lateral side 74 of the heat exchanger module 1, and the second frame bracket 22 is attached to the vehicle frame 8 at a second, lateral side 76 of the heat exchanger module 1. Bottom walls 52 and bottom wall holes 54 of the frame brackets 20, 22 are used with fasteners to mount the fan shroud 2 to the vehicle frame 8. The bottom wall holes 54 illustrated herein are circular, but in other embodiments, the bottom wall holes 54 can have other shapes. The bottom walls 52 are located at or below a middle plane 50 indicated by a dimensional middle plane or a plane through the center of mass of the heat exchanger module 1. The frame brackets 20, 22 also include back walls 56 and back wall holes 58 that connect the fan shroud 2 to the second heat exchanger 6.

The second heat exchanger 6 includes a first tank 84 with a first mounting bracket 62 and a second tank 86 with a second mounting bracket. The first mounting bracket 62 is connected to the first frame bracket 20, and the second mounting bracket is connected to the second frame bracket 22. The first frame bracket 20 and the second frame bracket 22 are connected to the vehicle frame 8, respectively at a first connection location 96 and a second connection location opposite of the first connection location. The first mounting bracket 62 and the second mounting bracket are connected to the vehicle frame 8, respectively, at a third connection location 98 and a fourth connection location opposite of the first connection location. A first distance 92 is defined between the first and the third connection locations 96, 98. A second distance is defined between the second and the fourth connection locations.

As illustrated in FIG. 3, a main module mount 102 is positioned on the periphery 17 of the fan shroud 2. The main module mount 102 has a first connection between the fan shroud 2 and the vehicle frame 8 and has a second connection between the second heat exchanger 6 and the vehicle frame 8. Since the main module mount 102 is over the center of gravity of the heat exchanger module 1, stress applied from the vehicle frame 8 to the heat exchanger module 1 is reduced compared to conventional designs.

The embodiment of the main module mount 102 in FIG. 3 illustrates a split main module mount 102 having a front isolator 104 providing the first connection and a rear isolator 106 providing the second connection. The main module mount 102 is installed on the vehicle frame 8. The front isolator 104 is installed in a pocket of the second heat exchanger 6, which is located at the third connection location 98 and a fourth connection location. Note that only the third connection 98 is visible in FIG. 3. The rear isolator 106 is installed opposite the front isolator 104 and adjacent the fan shroud 2. The rear isolator 106 is specifically located at the first connection location 96 and the second connection locations. Note that only the first connection 96 is visible in FIG. 3. The positioning of the front isolator 104 and the rear isolator 106 in relation to each other across the first distance 92 provides stability to the heat exchanger module 1 and reduces stress to the heat exchanger module 1. The need for placing stabilizer rods or tie rods at a top portion 78 and a bottom portion 79 of the second heat exchanger 6 is eliminated by the split main module mount 102. This results in a simpler installation of the heat exchanger module 1.

The second heat exchanger 6 is mounted to a top portion 78 of the fan shroud 2 by both the first tank 84 and the second tank 86 of the second heat exchanger 6. The first heat exchanger 4 is mounted to the top portion of the fan shroud 6 and is mounted to a bottom portion 79 of the fan shroud 2. In a heat exchanger module 1 in one frameless design, the module 1 is mounted to a vehicle via a direct connection to the first tank 84 and the second tank 86 of the second heat exchanger 6. This direct connection causes the stress of the module 1 to increase. As shown herein, the main module mount 102 has been found to decrease the stress applied from the vehicle to the heat exchanger module 1.

Rigid mounting support is provided to the first tank 84 and the second tank 86 of the second heat exchanger 6 by the fan shroud 2. In some designs, mounting structure extends the length of the first tank 84 and the second tank 86 downward from the vehicle frame 8 to align with a bottom portion 79 of the first heat exchanger 4. In contrast the structural fan shroud 2 provided herein provides direct mounting to the first and second tanks 84, 86. This is especially advantageous when the heat exchangers are different sizes, i.e., for when the second heat exchanger 6 is shorter than the first heat exchanger 4.

A depth 93 of the fan shroud 2 is at least greater than a depth 68 of a first heat exchanger core 66. The depth 93 of the fan shroud 2 may also be greater than the sum of depth 68 and a depth 72 of the second heat exchanger core 70.

Figure 5:
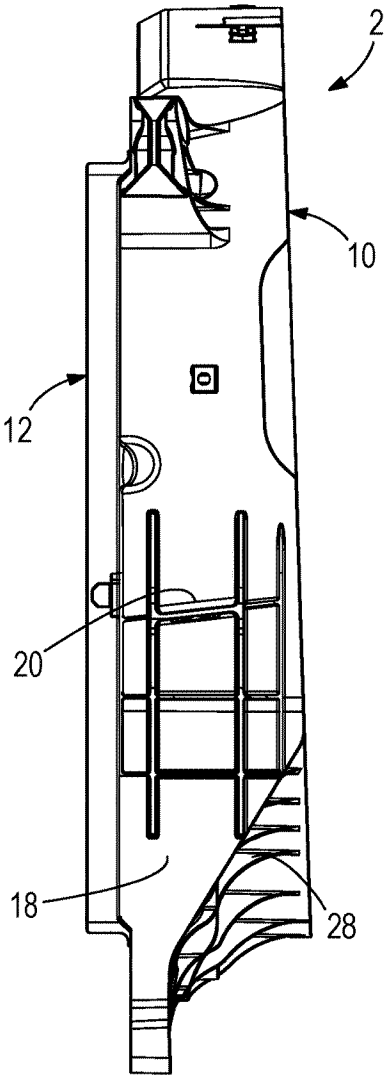
FIG. 5 is a side view of a fan shroud of FIG. 1.
Figure 4:
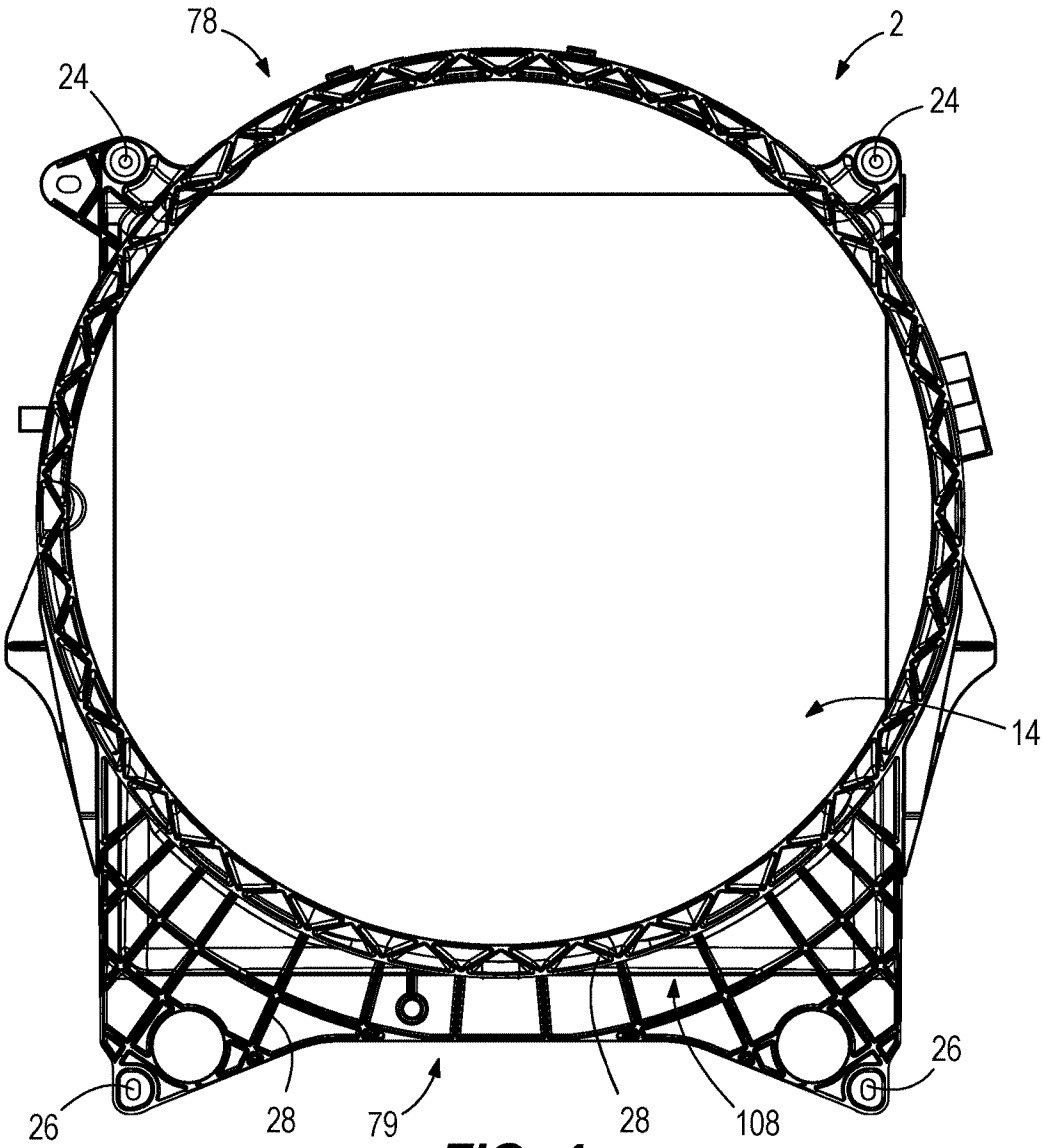
FIG. 4 is a front view of a fan shroud of FIG. 1.
Figure 7:
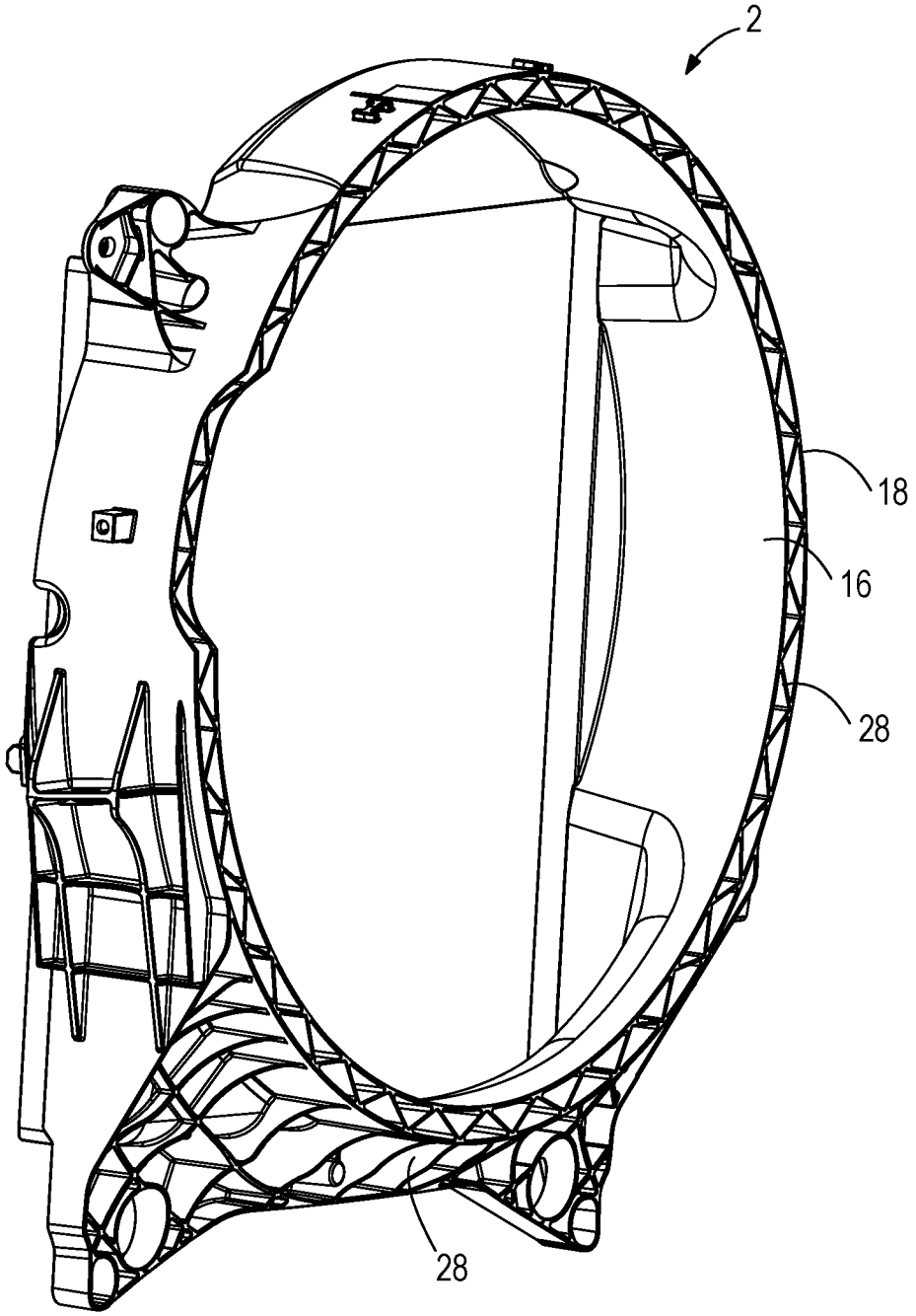
FIG. 7 is a front perspective view of a fan shroud of FIG. 1.
Figure 9:
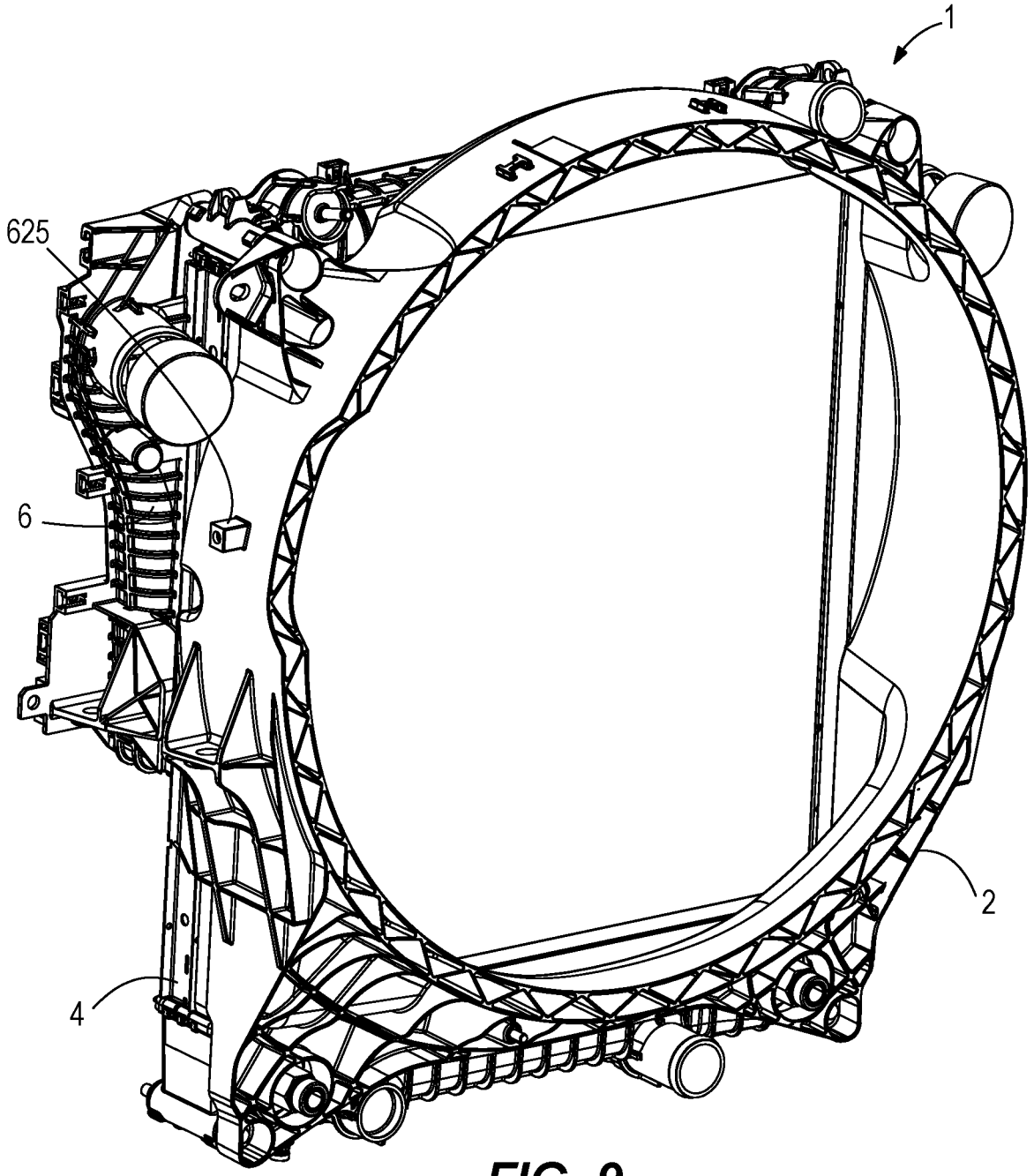
FIG. 9 is a front perspective view of a heat exchanger module of FIG. 1.
Figure 10:
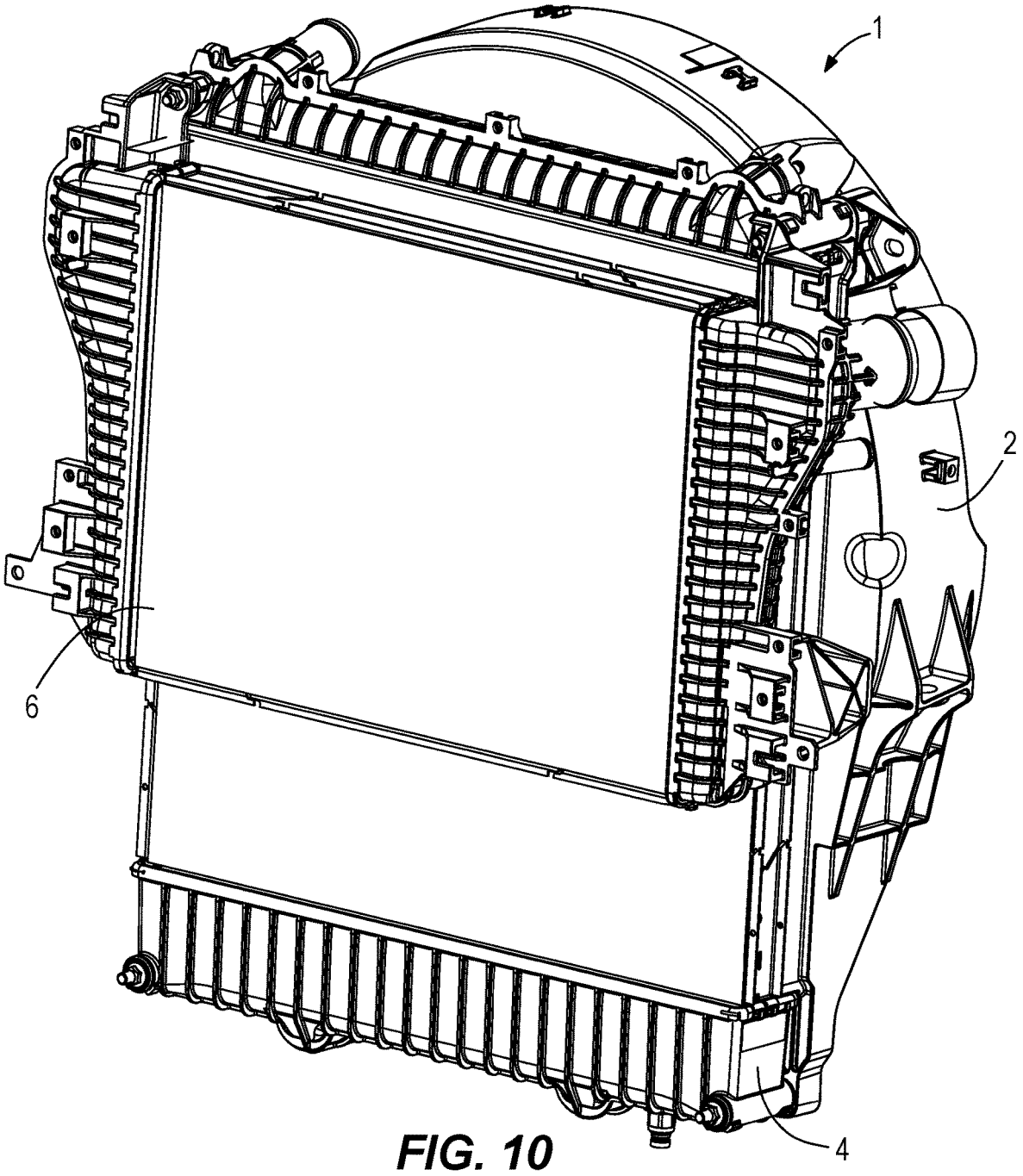
FIG. 10 is a rear perspective view of a heat exchanger module of FIG. 1.

FIGS. 4, 5, and 7 depict the fan shroud 2 without any surrounding structure. FIGS. 9 and 10 depict the fan shroud 2 without the vehicle frame 8 for easier visualization. The fan shroud 2 includes an air chamber 14 between an air inlet 12 on a first side of the fan shroud 2 and an air outlet 10 on a second side of the fan shroud 2. An air chamber wall 16 at least partially defines the air chamber 14. A fan (not shown) is positioned within the air chamber 14, and is configured to direct airflow across the first heat exchanger 4 and the second heat exchanger 6. The periphery 17 of the fan shroud 2 includes an outer support wall 18. Inner support walls 28 are attached to and support the outer support wall 18 and the air chamber wall 16. At least one inner support wall of the inner support walls 28 extends between the outer support wall 18 and the air chamber wall 16. Further, at least one inner support wall of the inner support walls 28 extends between the outer support wall 18 and the air chamber wall 16 on one side of the fan shroud 8, and another inner support wall of the inner support walls 28 extends between the outer support wall 18 and the air chamber wall 16 on an opposite side of the fan shroud 8.

Cavities 90 are defined by a ribbed surface 108 formed from the inner support walls 28. The cavities 90 extend in the depth direction and are positioned along the inner support walls 28 and the outer support walls 18. The webbed configuration of the cavities 90 adds increased rigidity to the structure of the fan shroud but without excessive weight and material cost. The added rigidity provided by the cavities 90 reduces displacement of the bottom portion of the first heat exchanger 4 when subjected to vibration inputs from the vehicle. As a result of the reduced vibration inputs, stability rod supports can be eliminated from the fan shroud 2.

The air chamber wall 16 of the fan shroud 2 further includes the air outlet 10 defined by an outlet wall 30 and the air inlet 12 defined by an inlet wall 32. The outlet wall 30 and inlet wall 32 define the extreme edges of the air chamber wall 16. The outer support walls 18 define an outer ring that surrounds the air chamber wall 16 and is connected to the air chamber wall 16 via inner support walls 28. Along a ring-like portion of the outer support wall 18, at least one stability rod mount 625 can be molded into the structure of the fan shroud 2. Stability rod mounts 625 allow for easier packaging of the second heat exchanger 6 and greater location flexibility of the heat exchanger module 1 by providing an additional location to mount the fan shroud 2 to the vehicle frame 8. Other attachment features, such as a condenser, fuel cooler lines, seals, hood cable, and lift eyes, can also be incorporated into the structure of the fan shroud 2.

Figure 6:
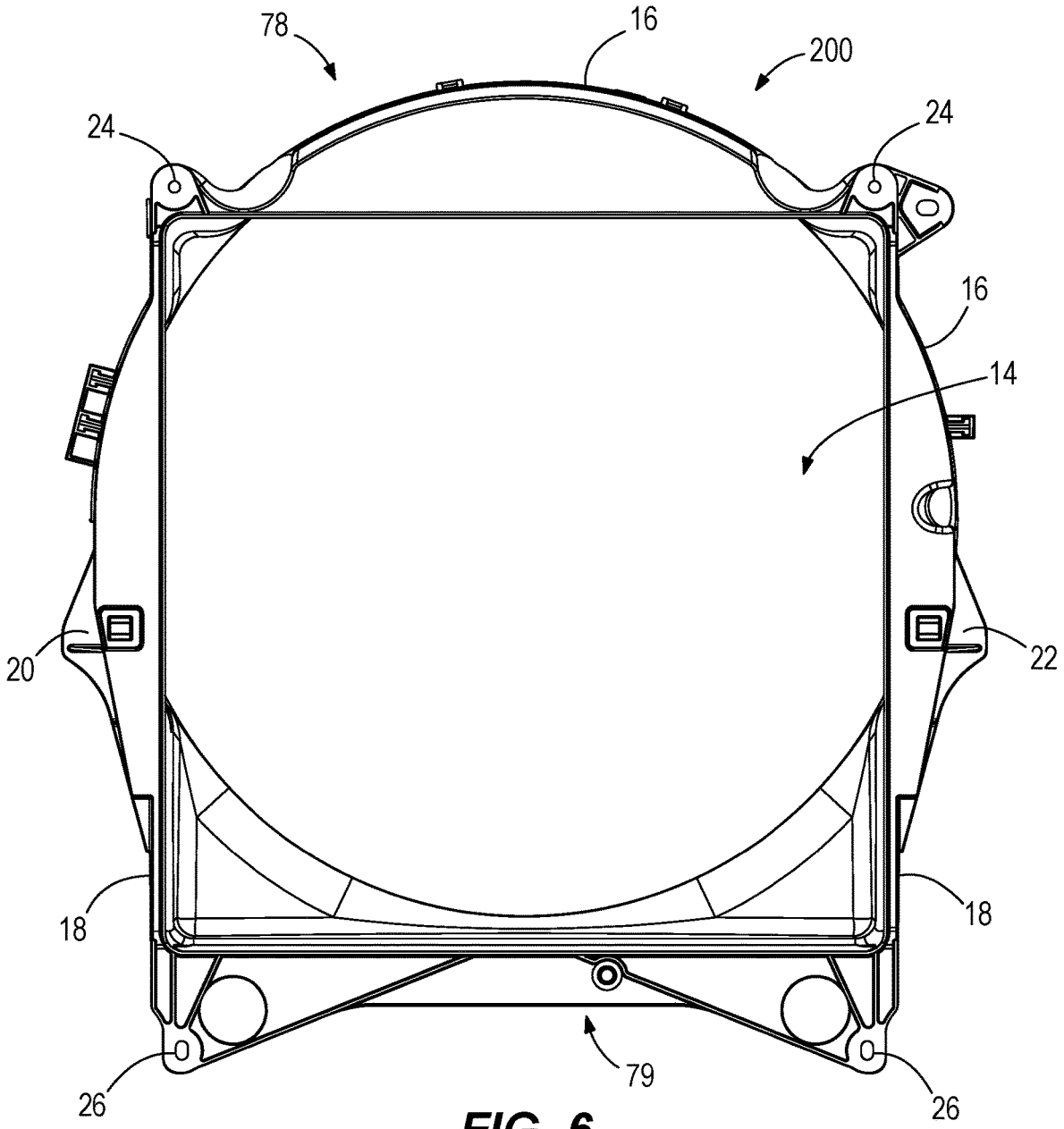
FIG. 6 is a rear view of a fan shroud of another embodiment.
Figure 8:
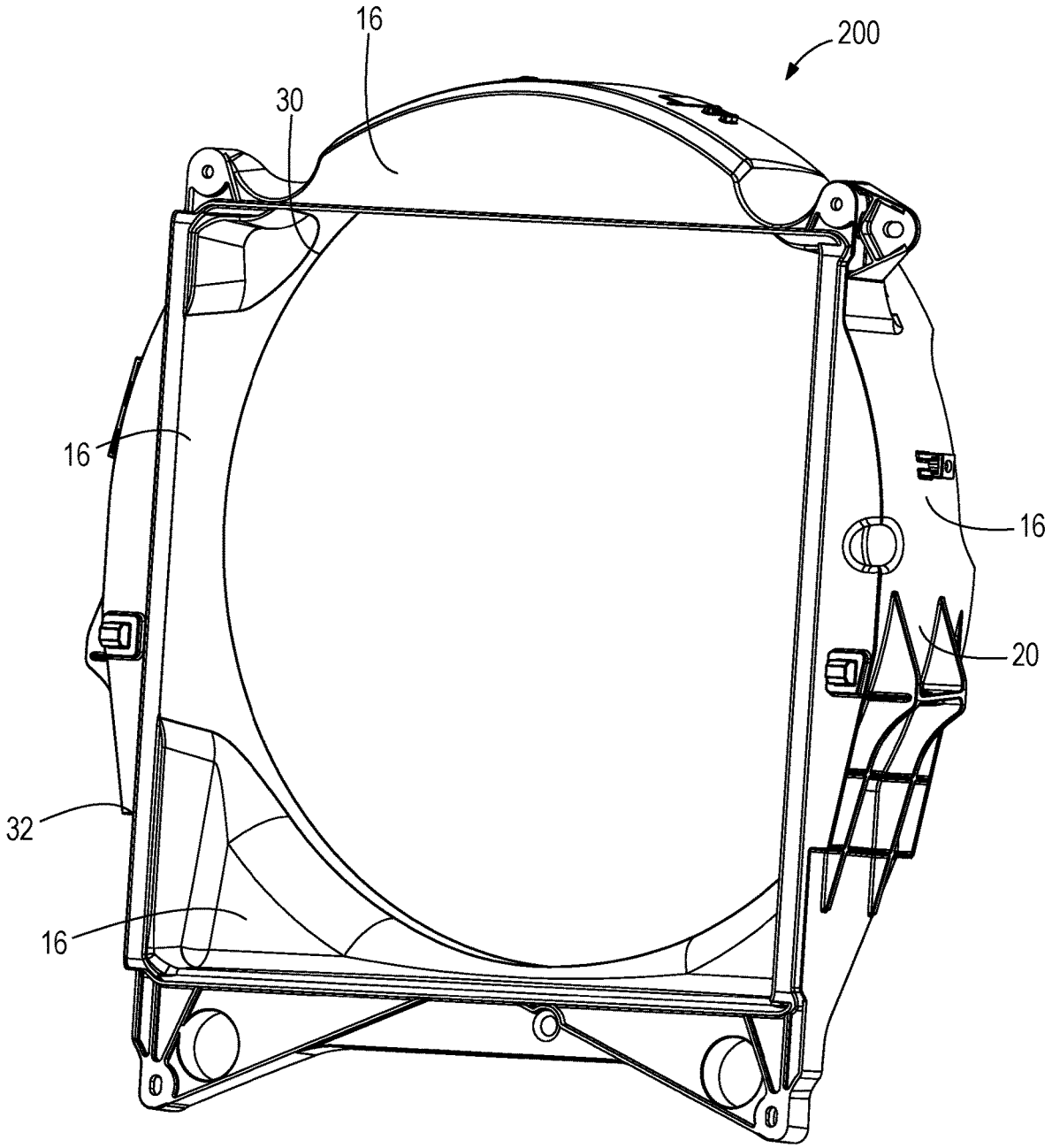
FIG. 8 is a rear perspective view of a fan shroud of FIG. 6.

FIGS. 6 and 8 depict an alternative embodiment of the fan shroud 200, illustrated without surrounding structure such as heat exchangers. The embodiments shown in FIGS. 6 and 8 differ from the previous embodiments in that the ribbed surface 108 and the cavities 90 are not provided in the structure of the fan shroud 200, or are provided but are not visible on the surface of the fan shroud 200. Instead, the fan shroud 200 is generally smooth in these areas. The fan shroud 200 can be, for example, molded or formed from a single piece. In some embodiments, the fan shroud 200 is a single piece of molded plastic. In other embodiments, the fan shroud 200 is a single piece of formed sheet steel. In the embodiments shown in FIGS. 6 and 8, there is no separate air chamber wall 16 and outer support wall 18, as these structures are one piece. Instead, there is only a single wall bounding the air chamber 14, denoted the air chamber wall 16 herein. The other geometry of the fan shroud 200 remains the same as the fan shroud 2 shown in, for example, FIG. 7, such that the mounting location and design of the other structure mounted to the fan shroud 200 remains unchanged compared to the structure mounted to the fan shroud 2.

Figure 11:
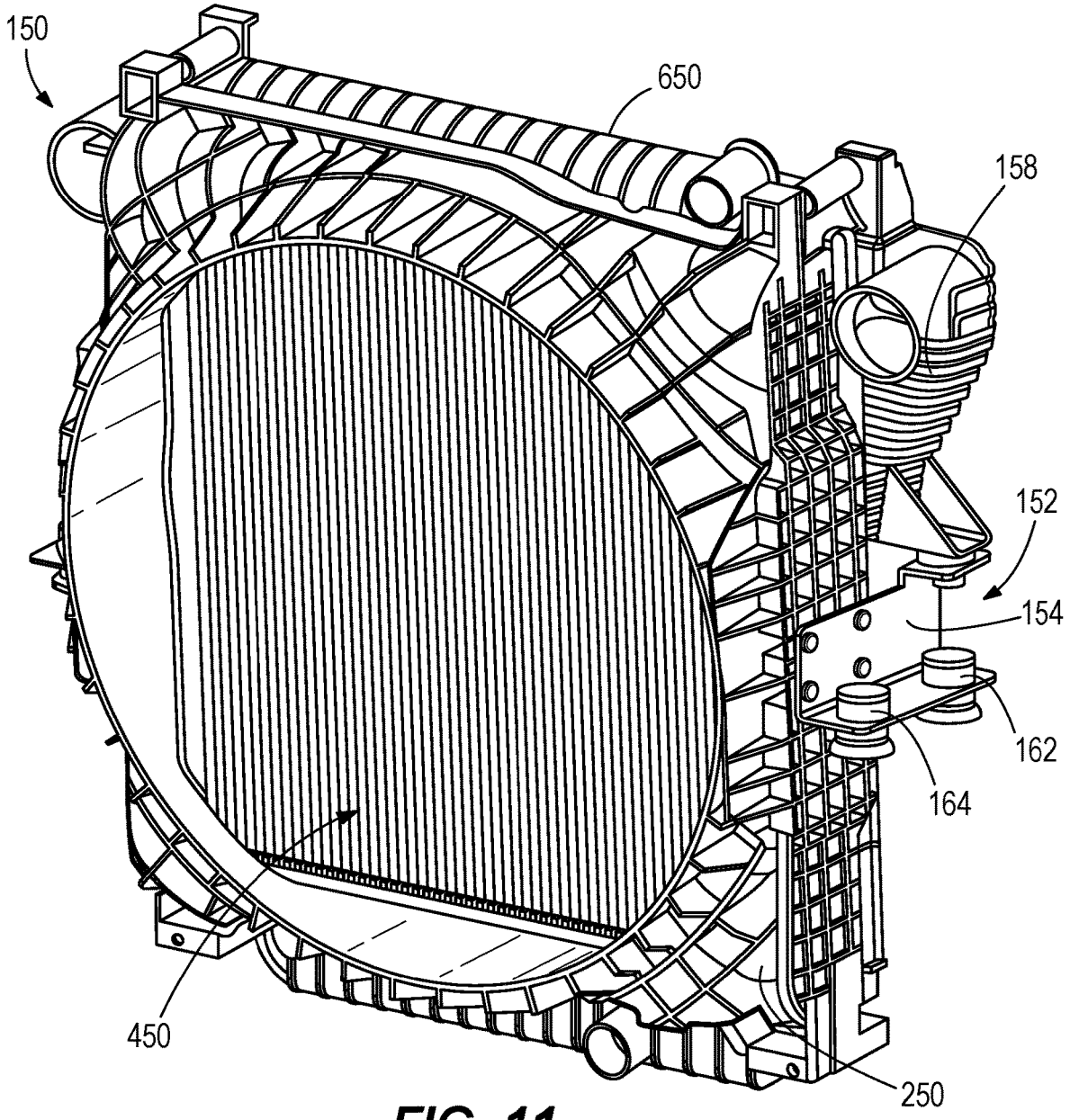
FIG. 11 is a front perspective of a heat exchanger module according to another embodiment.

FIG. 11 depicts yet another embodiment of the heat exchanger module 150 including a fan shroud 250, a first heat exchanger 450, and a second heat exchanger 650. The fan shroud 250 covers a periphery of the first heat exchanger 450. The second heat exchanger 650 is connected to a first lateral side of the first heat exchanger 450. The fan shroud 250 extends away from a second lateral side of the first heat exchanger 450, where the second lateral side is opposite of the first lateral side on the first heat exchanger 450.

FIG. 11 illustrates an embodiment of a split main module mount 152. The split main module mount 152 includes a first connecting bracket 154 that connects a first tank 158 of the second heat exchanger 650 to the fan shroud 250. The first connecting bracket 154 is an L-shaped bracket, with one side of the "L" extending parallel to a side of the shroud 250 and a second side of the "L" extending generally perpendicularly away from the side of the shroud 250. A second connecting bracket is provided on the opposite side of the shroud 250 but is obscured in FIG. 11. A front isolator 162 and a rear isolator 164 are positioned within holes on the connecting bracket 154, and the front and rear isolators 162, 164 are connected to the vehicle frame (not illustrated in FIG. 11). The front and rear isolators 162, 164 are positioned on the side of the "L" extending perpendicularly away from the side of the shroud 250. Due to the positioning of the front and rear isolators 162, 164, torsional movement of the heat exchanger module 150 is reduced, which in turn protects the first and second heat exchangers 450, 650 from damage during use.

Figure 12:
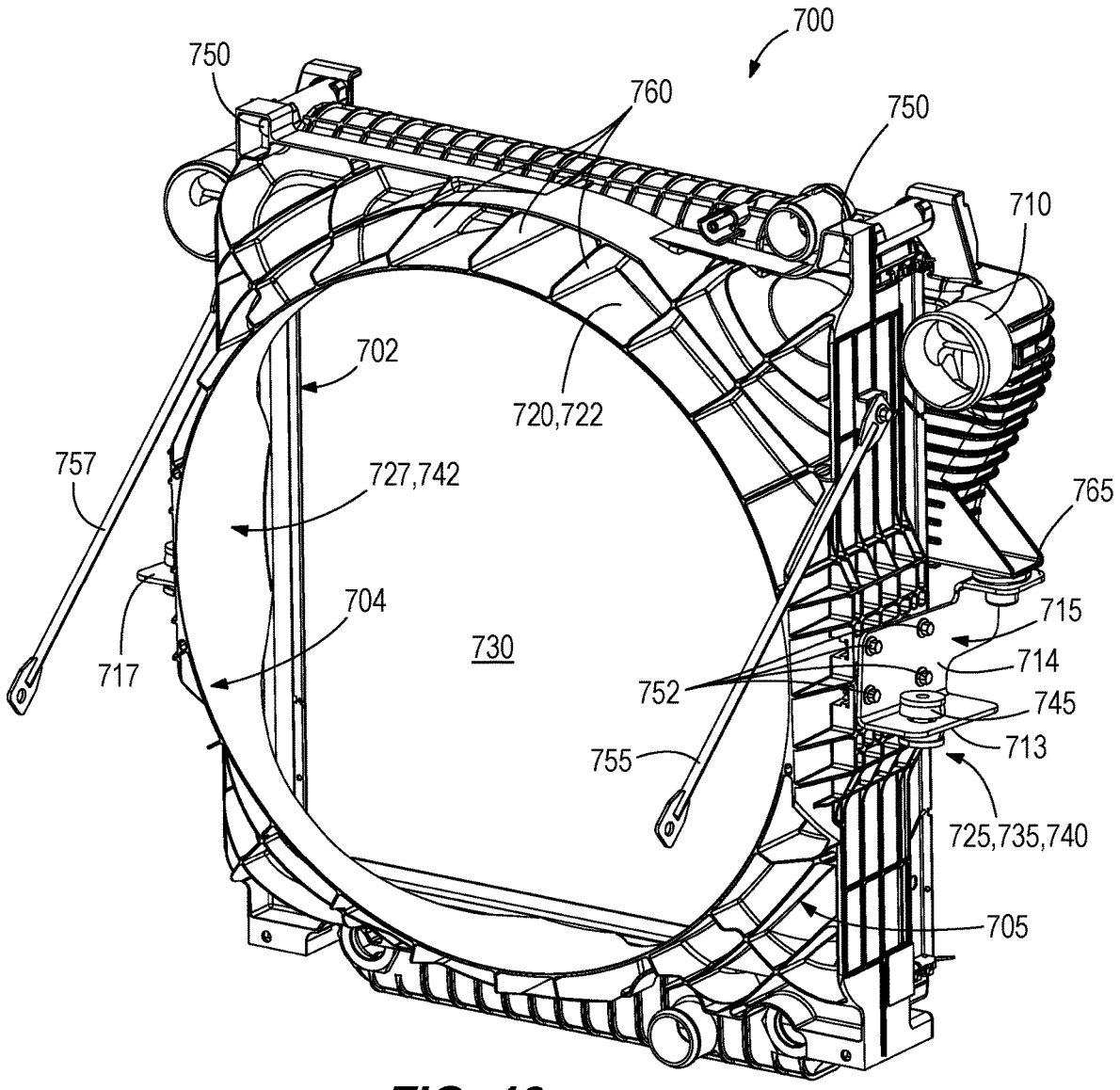
FIG. 12 is a front perspective of a heat exchanger module according to another embodiment.

FIG. 12 illustrates an embodiment of a heat exchanger module 700. The heat exchanger module 700 is generally symmetric and includes the same structure on the side of the heat exchanger module 700 shown in FIG. 12 as on the side of the heat exchanger module 700 obscured in FIG. 12. The heat exchanger module 700 includes a fan shroud 705 and a radiator 710 coupled together such that air passes through the radiator 710 and then through the fan shroud 705 when the heat exchanger module 700 is in operation. The air passes through the fan shroud 705 from an air inlet 702 of an air chamber wall 720 to an air outlet 704 of an air chamber wall 720. An air chamber 730 through which the air flows is defined by the air chamber wall 720. The air chamber wall 720 extends around the entire circumference of the air chamber 730. The air chamber wall 720 includes a first section 725 and a second section 727 opposite of the first section 725 across the air chamber 730. The air chamber wall 720 includes a cylindrical section 722, which is made up of the first and second sections 725, 727, and bracing walls 760. The cylindrical section 722 is an unbroken cylindrical wall that extends from the air inlet 702 to the air outlet 704. The bracing walls 760 are positioned radially about the cylindrical section 722 and extend away from the cylindrical section 722 in a direction radially outward from a hypothetical centerline of the cylindrical section 722. The cylindrical section 722, and generally the air chamber wall 720, defines a passageway for air to pass from the air inlet 702 to the air outlet 704. The bracing walls 760 provide strength and rigidity to the fan shroud 705 such that the fan shroud 705 can bear substantially the entire weight of the radiator 710 and can absorb vibrations from the vehicle (not shown) in which the heat exchanger module 700 is installed. In some embodiments, two or more radiators are included in the heat exchanger module 700 and the fan shroud 705 can bear substantially the entire weight of the two or more radiators. By absorbing the vibrations from the vehicle, the fan shroud 705 helps to protect the relatively more fragile radiator 710 from damage during operation of the vehicle.

The radiator 710 is mounted to the fan shroud 705 via fasteners 750, which are shown as bolts but could take the form of clips, snaps, or other fasteners. The radiator 710 is mounted against the air inlet 702 such that cooling air can flow through the radiator 710 and then flow directly into the air chamber 730. The fan shroud 705 is mounted to the vehicle frame (not shown) via first and second frame brackets 715, 717. The first and second frame brackets 715, 717 substantially support the entire load of the heat exchanger module 700. The first and second frame brackets 715, 717 each include a single connection point (via a hole) to the vehicle frame. The single connection point includes an isolator 745 within the hole to absorb vibration from the vehicle frame and prevent the vibrations from causing damage to the relatively fragile radiator 710. However, because each of the first and second frame brackets 715, 717 only includes a single hole and therefore a single connection point (i.e., at the isolators 745), tie rods 755, 757 are provided. The tie rods 755, 757 extend from opposite sides of the fan shroud 705 to the vehicle frame, but connect to the vehicle frame at a location remote from where the first and second frame brackets 715, 717 connect to the vehicle frame. In FIG. 12, the first and second tie rods 755, 757 extend generally from the fan shroud 705 and away from the radiator 710. The tie rods 755, 757 serve to limit the action of rotational forces about the first and second frame brackets 715, 717, i.e., forces causing a rotation about an axis extending from the first frame bracket 715 to the second frame bracket 717.

The fan shroud 705 can be divided into two sections, the first section 725 and the second section 727, which (as installed) correspond to left and right sides of the fan shroud 705. The first section 725 includes a first mounting region 740, where the first frame bracket 715 is attached to the fan shroud 705. The second section 727 includes a second mounting region 742, where the second frame bracket 717 is attached to the fan shroud 705. The first and second frame brackets 715, 717 are connected to the first and second mounting regions 740, 742 via fasteners 752, although other methods of connection are possible, such as welding. The first and second mounting regions 740, 742 are areas of increased thickness of the air chamber wall 720 such that a strong connection can be obtained between the fan shroud 705 and the first and second frame brackets 715, 717.

As shown in FIG. 12, the first and second mounting regions 740, 742 can include a lattice structure 735, to provide additional strength and stiffness to the connection point between the fan shroud 705 and the first and second frame brackets 715, 717. The lattice structure includes a plurality of horizontal walls and a plurality of vertical walls that extend away from the cylindrical section 722 and intersect to form the lattice structure 735. In the embodiment shown in FIG. 12, the horizontal and vertical walls intersect at about right angles, however, the horizontal and vertical walls could intersect at any angle to achieve a similar effect. Further, the horizontal and vertical walls could be non-uniform in size and spacing relative to one another.

The first and second frame brackets 715, 717 also include a first radiator mount flange 765, to which the radiator 710 is mounted directly to the first and second frame brackets 715, 717 (i.e., without or in addition to the fan shroud 705 being provided as intervening structure between the radiator 710 and the first and second frame brackets 715, 717. A second radiator mount flange is present on the second frame bracket 717, but is obscured in FIG. 12. A damper or rubber isolator may be placed at the connection between the radiator 710 and the first radiator mount flange 765. The first radiator mount flange 765 provides additional support for the radiator, such that the fan shroud 705 does not bear the entire weight of the radiator 710.

FIG. 12 illustrates an embodiment of the first frame bracket 715 that includes a bottom wall 713, via which the first frame bracket 715 is connected to the vehicle frame, and a back wall 714, via which the first frame bracket 715 is connected to the first mounting region 740. The first frame bracket 715 also includes the first radiator mount flange 765, discussed above. The bottom wall 713 extends away from the back wall 714 at an opposite side of the first frame bracket as the radiator mount flange extends away from the back wall 714. In some embodiments, the bottom wall 713 and the first radiator mount flange 765 extend parallel to one another. In some embodiments, the bottom wall 713 and the back wall 714 extend 90 degrees from one another. This results in the first frame bracket 715 having a generally "C" shaped cross section. While not visible in FIG. 12, the second frame bracket 717 can be the same, but a mirror image of, the first frame bracket 715. In some embodiments, the first frame bracket 715 and the second frame bracket 717 are located at opposite radial positions about the air chamber wall 720. Thus, in some embodiments, the bottom wall 713 of the first frame bracket 715 and the bottom wall of the second frame bracket 717 define a common plane and carry substantially the entire load of the heat exchanger module 700.

Figure 13:
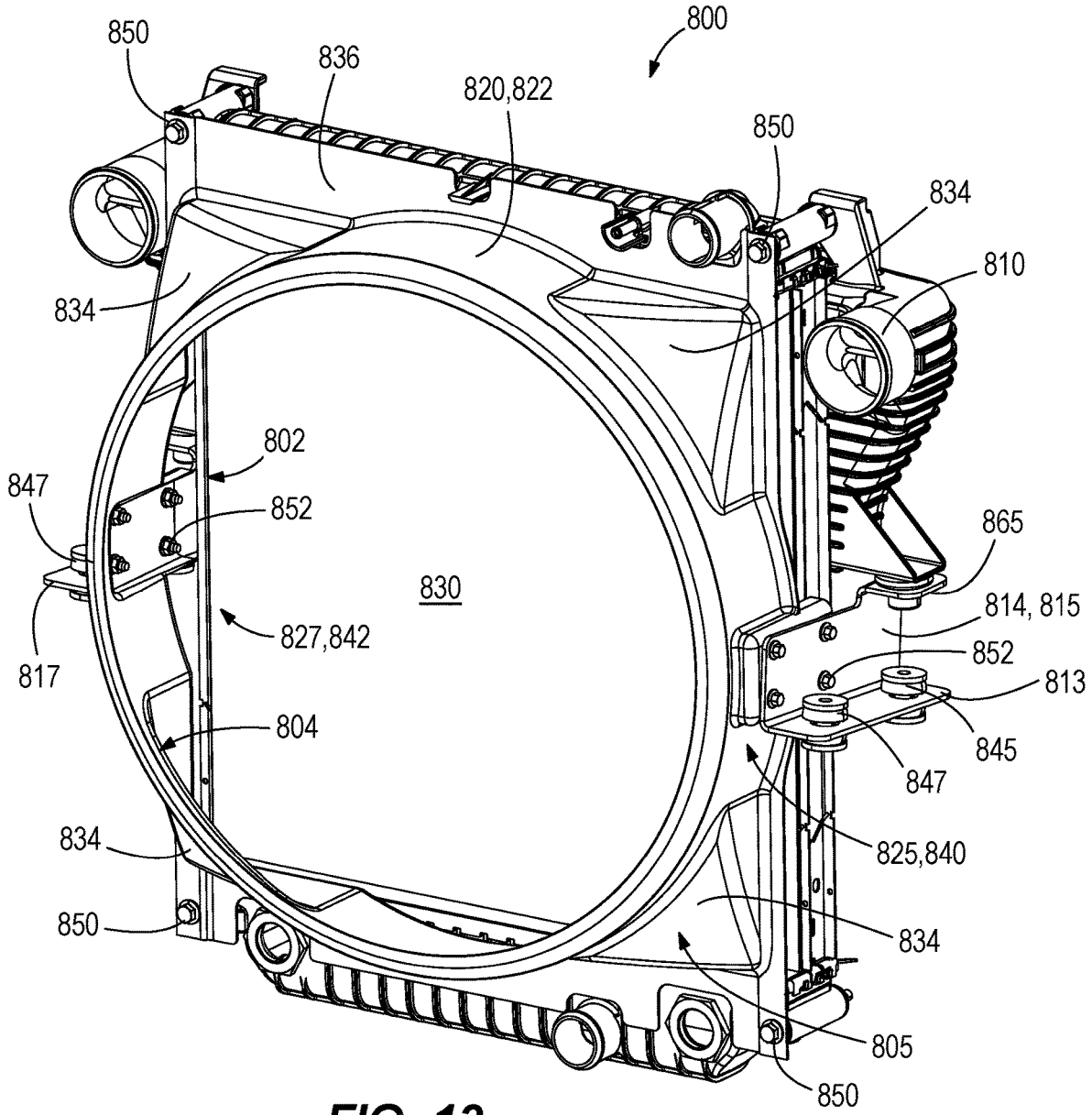
FIG. 13 is a front perspective of a heat exchanger module according to another embodiment.

FIG. 13 illustrates an embodiment of a heat exchanger module 800. The heat exchanger module 800 is generally symmetric and includes the same structure on the side of the heat exchanger module 800 shown in FIG. 13 as on the side of the heat exchanger module 800 obscured in FIG. 13. The heat exchanger module 800 includes a fan shroud 805 and a radiator 810. While only one radiator 810 is shown in FIG. 13, more than one radiator 810 can be provided, where the radiators 810 can be stacked vertically or horizontally relative one another. The fan shroud 805 is connected to the radiator 810 via fasteners 850, which are shown as bolts located at each corner of a generally square-shaped portion (i.e., a plate 836) of the fan shroud 805. Other fastener types are contemplated, for example clips, retainers, snaps, or the like. Additional fasteners 850 can be provided in addition to the four shown in FIG. 13 and can be provided at locations other than the corners of the generally square shaped fan shroud 805.

The fan shroud 805 includes an air chamber wall 820 having an air inlet 802 and an air outlet 804, where the air inlet 802 is faces the radiator 810 and the air outlet 804 faces away from the radiator 810. The air chamber wall 820 includes a cylindrical region 822 defining an air chamber 830, which is where the air passes through the fan shroud 805. As air is drawn through the radiator 810, it passes through the air chamber 830 generally moving from the air inlet 802 to the air outlet 804. The air chamber 830 is also defined by four corner regions 834 of the fan shroud 805. The corner regions 834 extend away from the cylindrical region 822 of the air chamber wall so that the air chamber 830, at the air inlet 802, is generally square to match the dimensions of the radiator 810. The cylindrical region 822 and the corner regions 834 together define the air chamber wall 820. The generally square air inlet 802 of the air chamber 830 thus provides a smooth transition from the generally square radiator 810 to the generally circular air outlet 804 so that air can flow through the air chamber 830 with minimal resistance. The cylindrical region 822 of the fan shroud 805 is shaped so that a fan (not shown) can be provided within the air chamber 830 to flow air through the air chamber 830.

The fan shroud 805 further includes a plate 836 connected to the air inlet 802 of the air chamber wall 820. The plate 836 is generally square to match the generally square shape of the radiator 810. The plate 836 includes locations where the fasteners 850 extend through the plate 835 to connect the fan shroud 805 to the radiator 810. The plate 836 surrounds the air inlet 802 of the air chamber wall 820 and extends radially outward from the air inlet 802. The plate 836 also extends radially outward from the four corner portions 834.

The fan shroud 805 connects to a vehicle frame (not shown) via a first frame bracket 815 and a second frame bracket 817. The first frame bracket 815 connects to the air chamber wall 820 at a first section 825. The second frame bracket 817 connects to the air chamber wall 820 at a second section 827. The first section 825 is positioned at an opposite side across the air chamber 830 from the second section 827. The fan shroud 805 is configured such that substantially all of the weight of the radiator 810 is transferred through the air chamber wall to be supported by the first and second frame brackets 815, 817.

The first and second frame brackets 815, 817 both include a back wall 814 and a bottom wall 813. In FIG. 13, the bottom wall 813 is positioned at about 90 degrees relative to the back wall 814. The first section 825 and the second section 827 are opposite lateral sides of the cylindrical region 822 of the air chamber wall 820. The first section 825 and the second section 827 include a first mounting region 840 and a section mounting region 842, respectively, which are areas of increased thickness of the air chamber wall 820 to facilitate the mounting of the fan shroud 805 to the vehicle frame. The first frame bracket 815 is connected to the first mounting region 840 via fasteners 852 and the second frame bracket 817 is connected to the second mounting region 842 via fasteners 852. However, other attachment methods could be used, such as welding. The back wall 814 of the first frame bracket 815 connects to the first section 825. The back wall of the second frame bracket 817 connects to the second section 827.

In some embodiments, the first and second frame brackets 815, 817 can include a first radiator mount flange 865. The first radiator mount flange 865 connects directly to the radiator 810 to provide further support the radiator 810. A second radiator mount flange is present on the second frame bracket 817, but is obscured in FIG. 13. The first and second frame brackets 815, 817 are configured to bear substantially all of the load of the heat exchanger module 800 (i.e., the fan shroud 805 and the radiator 810, and any additional radiators). The first and second frame brackets 815, 817, along with the fan shroud 805, are also configured to absorb vibrations from the vehicle frame so that these vibrations are not passed to the relatively fragile radiator 810. The first and second frame brackets 815, 817 can each include two connection points (via holes in the bottom walls 813) to the vehicle frame. The holes in the bottom walls 813 are where the first and second frame brackets 815, 817 are bolted to the vehicle frame, although other attachment methods are contemplated. Front and rear isolators 845, 847 can be provided in the holes of the first and second frame brackets 815, 817 to help absorb vibrations from the vehicle frame. The front and rear isolators 845, 847 reduce damage and wear on the radiator 810 by absorbing vibrations from the vehicle frame before the vibrations reach the radiator 810. The front and rear isolators 845, 847 damp vibrations between the vehicle frame and the first and second frame brackets 815, 817. Rubber isolators, or similar damping structure, can also be provided at the attachment point between the first radiator mount flange 865 and the radiator 810. The two connection points provide a significant difference from the first and second frame brackets 715, 717, illustrated in FIG. 12. The rest of the first and second frame brackets 815, 817 is substantially the same as the embodiment shown in FIG. 12.

Advantageously, providing the two connection points in the first and second frame backets 815, 817 limits twisting and rotational forces on the radiator 810. As one example of such a force, the motion of the vehicle can cause the heat exchanger module 800 to rotate about an axis extending from the first frame bracket 815 to the second frame bracket 817. This rotational force is mitigated through the use of two connection points in the first frame bracket 815 and the second frame bracket 817. By limiting the twisting and rotational forces on the radiator 810, the module assembly 800 does not require the first and second tie rods 755, 757 shown in FIG. 13. This reduces cost and enables easier assembly of the heat exchanger module 800 compared to the heat exchanger module 700 shown in FIG. 12.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A fan shroud assembly for mounting a radiator to a vehicle frame, the fan shroud assembly comprising:

a fan shroud including:

an air chamber wall defining an air chamber and configured to support the radiator;

an air outlet at a first side of the air chamber wall;

an air inlet at a second side of the air chamber wall opposite from the first side;

a first section of the air chamber wall extending between the air inlet and the air outlet; and a second section of the air chamber wall extending between the air inlet and the air outlet, the second section positioned across the air chamber from the first section;

a first frame bracket configured to mount the fan shroud to the vehicle frame, the first frame bracket including a bottom wall and a back wall; and a second frame bracket configured to mount the fan shroud to the vehicle frame, the second frame bracket including a bottom wall and a back wall, wherein the bottom wall of the first frame bracket is configured to connect to the vehicle frame;

wherein the bottom wall of the first frame bracket includes a hole;

wherein the back wall of the first frame bracket is mounted to the first section of the air chamber wall;

wherein the bottom wall of the second frame bracket is configured to connect to the vehicle frame;

wherein the bottom wall of the second frame bracket includes a hole; and wherein the back wall of the second frame bracket is mounted to the second section of the air chamber wall.

2. The fan shroud of claim 1, wherein the air chamber wall extends unbroken about an entire circumference of the air chamber.

3. The fan shroud of claim 1, wherein the air chamber wall includes a plate surrounding the air chamber and extending radially away from the air inlet, the plate being configured to support a weight of the radiator, and wherein the fan shroud is configured such that substantially all of the weight of the radiator is transferred through the air chamber wall to be supported by the first frame bracket and the second frame bracket.

4. The fan shroud of claim 1, wherein the air chamber wall forms a cylinder about the air chamber, and wherein the air chamber is further defined by four corner portions spaced around the air chamber, the corner portions forming a transition in the air chamber such that the air inlet, which is formed by the combination of the cylinder and the four corner portions, is substantially square and the air outlet, which is formed by the cylinder, is substantially round.

5. The fan shroud of claim 4, wherein the air chamber wall includes a plate surrounding the air chamber and extending radially away from the air inlet and from the four corner portions, the plate being configured to support a weight of the radiator attached to the plate, and wherein the fan shroud is configured such that substantially all of the weight of the radiator is transferred through the air chamber wall to be supported by the first frame bracket and the second frame bracket.

6. The fan shroud of claim 1, wherein the first frame bracket and the second frame bracket are located at opposite radial positions about the air chamber wall.

7. The fan shroud of claim 1, wherein the first frame bracket is mounted to a first mounting region, wherein the second frame bracket is mounted to a second mounting region, and wherein the first and second mounting regions being areas of increased thickness of the air chamber wall.

8. The fan shroud of claim 7, wherein the first and second mounting regions include a lattice structure each having a plurality of intersecting walls.

9. The fan shroud of claim 1, wherein the fan shroud is formed from stamped steel.

10. The fan shroud of claim 1, wherein the bottom wall of first frame bracket includes two holes, wherein the bottom wall of the second frame bracket includes two holes, wherein the two holes of the bottom wall of the first frame bracket each have an isolator positioned therein, wherein the two holes of the bottom wall of the second frame bracket each have an isolator positioned therein, and wherein the isolators are configured to damp vibration between the vehicle frame and the first frame bracket and between the vehicle frame and the second frame bracket.

11. The fan shroud of claim 1, wherein a first tie rod extends from the first section of the air chamber wall and is configured to mount to the vehicle frame, wherein a second tie rod extends from the second section of the air chamber wall and is configured to mount to the vehicle frame, and wherein the first and second tie rods extend from the air chamber wall past the air outlet and away from the first and second brackets.

12. The fan shroud of claim 11, wherein the holes of the first and second mounting brackets have an isolator positioned therein, the isolators configured to damp vibration between the vehicle frame and the first frame bracket and between the vehicle frame and the second frame bracket.

13. The fan shroud of claim 1, wherein the first bracket includes a first radiator mounting flange extending away from the back wall of the first bracket substantially parallel to and offset from the bottom wall of the first bracket, wherein the second bracket includes a second radiator mounting flange extending away from the back wall of the second bracket substantially parallel to and offset from the bottom wall of the second bracket, and wherein the first and second radiator mounting flanges are configured to have the radiator mounted thereto.

14. The fan shroud of claim 1, wherein the air chamber wall is generally cylindrical with a centerline extending from the air inlet to the air outlet, wherein the air chamber wall extends unbroken about the air chamber, and wherein the fan shroud includes bracing walls positioned radially about the air chamber wall and extending away from the centerline of the air chamber wall.

15. The fan shroud of claim 1, wherein the fan shroud is formed from a plastic.

16. A heat exchanger module including the fan shroud of claim 1 and the radiator mounted to and substantially supported by the fan shroud.

17. The heat exchanger module of claim 16, wherein the air chamber wall includes a plate surrounding the air chamber and extending radially away from the air inlet, wherein the plate is square-shaped, and wherein the radiator is mounted to the plate by fasteners positioned at each corner of the square-shaped plate.

18. The heat exchanger module of claim 16, wherein the radiator is a first radiator, and wherein the heat exchanger module comprises a second radiator, the second radiator also being substantially supported by the fan shroud.

19. The heat exchanger module of claim 16, wherein the bottom wall of first frame bracket includes two holes, wherein the bottom wall of the second frame bracket includes two holes, wherein the two holes of the bottom wall of the first frame bracket each have an isolator positioned therein, wherein the two holes of the bottom wall of the second frame bracket each have an isolator positioned therein, and wherein the isolators are configured to damp vibration between the vehicle frame and the radiator.

20. The heat exchanger module of claim 16, wherein the bottom wall of first frame bracket and the bottom wall of the second frame bracket define a common plane and carry substantially the entire structural load of the heat exchanger module.

* * * * *